United States Patent [19]

Voss et al.

[11] 4,266,728

[45] May 12, 1981

[54] LEAKLESS FUEL INJECTION NOZZLE AND HOLDER ASSEMBLY

[75] Inventors: James R. Voss, Wilbraham; Richard E. Vanderpoel, Granby, both of Mass.

[73] Assignee: Ambac Industries, Incorporated, Springfield, Mass.

[21] Appl. No.: 972,517

[22] Filed: Dec. 22, 1978

[51] Int. Cl.[3] ..... F02M 47/02

[52] U.S. Cl. ..... 239/533.8; 239/533.9

[58] Field of Search ..... 239/533.3–533.9, 239/533.11, 533.12, 584

[56] References Cited

U.S. PATENT DOCUMENTS

| | | | |
|---|---|---|---|
| 2,374,614 | 4/1945 | Nichols | 239/533.8 |
| 2,507,355 | 5/1950 | Sola | 239/533.3 |
| 2,556,369 | 6/1951 | Hogeman | 239/533.8 |
| 3,451,626 | 6/1969 | Roosa | 239/533.11 |
| 3,469,793 | 9/1969 | Guertler | 239/533.8 |
| 3,738,576 | 6/1973 | O'Neill | 239/533.8 |

FOREIGN PATENT DOCUMENTS 124179 3/1919 United Kingdom .

OTHER PUBLICATIONS

"Caterpillar 3400 Series Engines", Automotive Eng'g. Congress, Detroit, Mich., Feb. 25–Mar. 1, 1974, Pub. No. 740,038, Soc. Auto. Engineers, pp. 1 and 16.

"New Robert Bosch Developments for Diesel Fuel Injection", Automotive Eng'g. Congress, Detroit, Mich., Feb. 23–27, 1976, SAE Pub. No. 760,127, pp. 1, 9, 10.

*Primary Examiner*—Robert B. Reeves

*Attorney, Agent, or Firm*—Richard D. Weber

[57] ABSTRACT

A fuel injection nozzle and holder assembly of conventional construction is made leakless by eliminating the leakoff passages from the spring chamber. An unreasonable buildup of leakage fuel pressure in the spring chamber is prevented by relieving the pressure in the fuel delivery passages between injection intervals to permit leakage from the spring chamber and a stabilization of the spring pressure. A continuously open passage is provided between the spring chamber and the valve bore to prevent a sealing of the spring chamber by the nozzle valve during the injection interval and thus provide a predictable spring chamber pressure augmenting the nozzle closing force of the spring.

9 Claims, 5 Drawing Figures

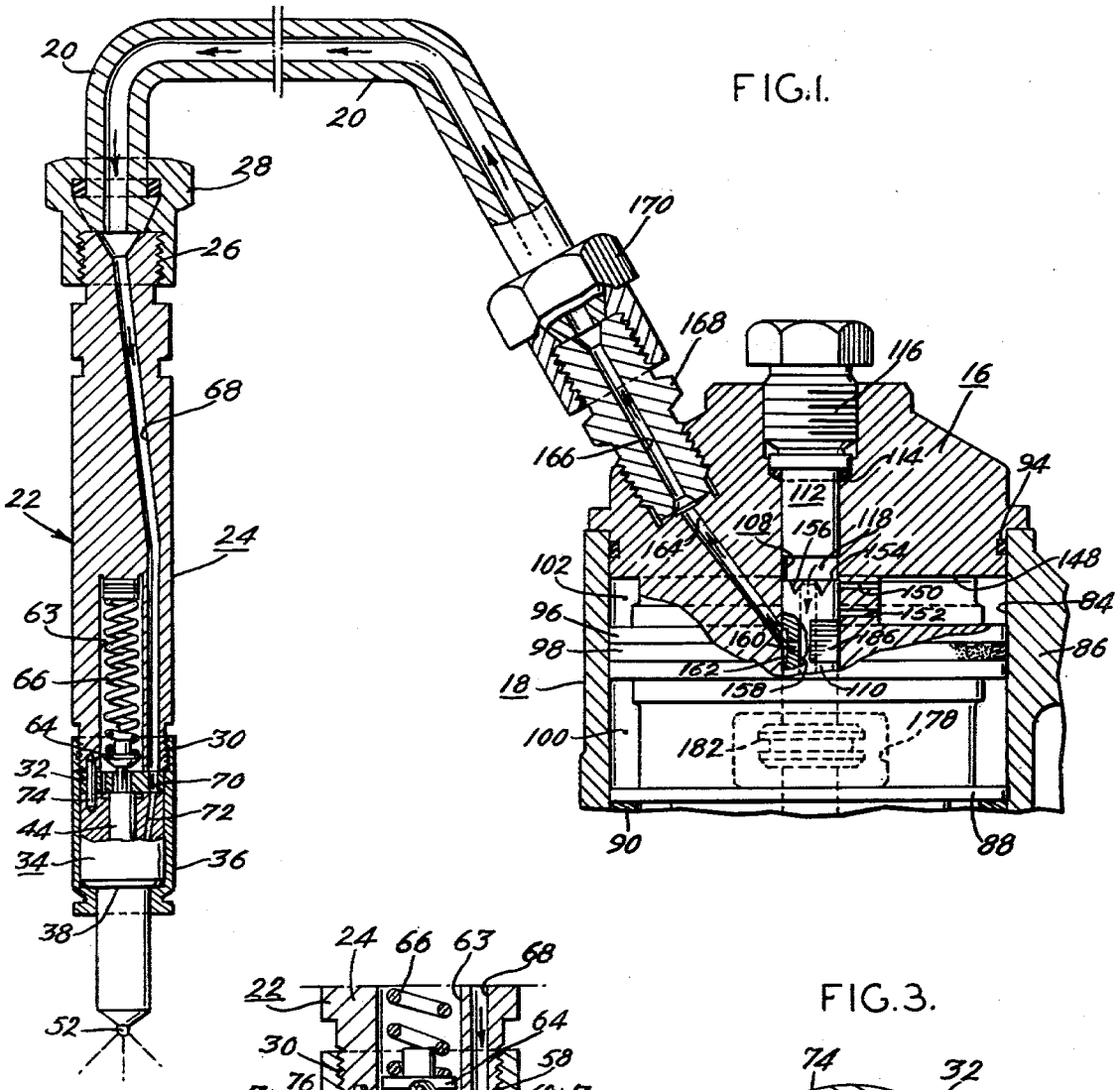
FIG. 1.
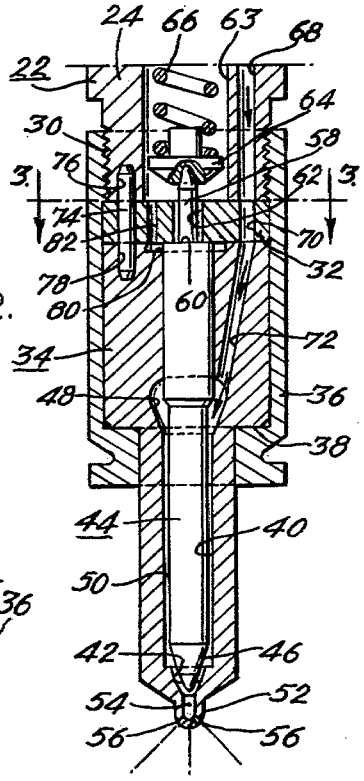
FIG. 2.
FIG. 3.
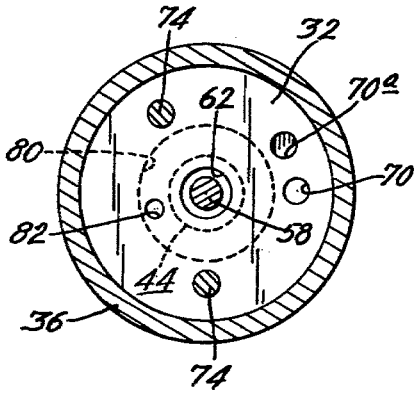
FIG. 5.
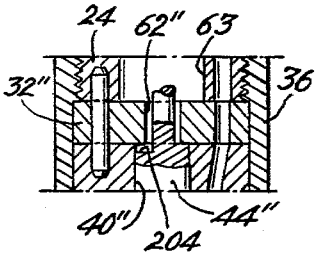
FIG. 4.
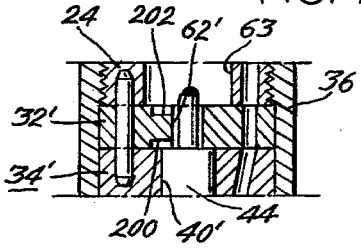

LEAKLESS FUEL INJECTION NOZZLE AND HOLDER ASSEMBLY

BACKGROUND OF THE INVENTION

The present invention relates generally to fuel injection systems for internal combustion engines and relates more particularly to leakless nozzle and holder assemblies for use with multi-cylinder diesel engines.

In the conventional fuel injection nozzle and holder assembly, leakage fuel which passes along the nozzle valve into the spring chamber is removed from the holder assembly by an external leakoff harness connected to the fuel sump. Although such an arrangement requires additional external plumbing to be affixed to already overly complicated engines, the leakoff systems were considered necessary in order to prevent an unreasonable buildup of pressure within the spring chamber which could modify and interfere with the proper and predictable action of the spring in controlling the opening and closing of the nozzle valve.

Modern injection systems have been developed which either by elimination of the pump delivery valve or by other pressure relieving means provide a substantial reduction in the delivery line pressure between injection intervals. Assuming the spring chamber volume is adequate, it is possible to operate essentially conventional fuel injection nozzle and holder assemblies with such types of pumps without a separate arrangement for the removal of leakage fuel from the spring chamber. In such systems, the spring chamber fuel pressure is permitted to build up to a certain predictable level, at which it becomes stabilized and assists the spring in providing a closing force against the valve. This arrangement is particularly advantageous since the leakage fuel pressure in the spring chamber will be smaller under low speed and low load conditions when it is desirable to have a smaller nozzle opening force.

A potential difficulty with the described arrangement is the sealing of the spring chamber by the engagement of the valve with the valve stop means during the injection interval which prevents leakage fuel from penetrating into the spring chamber during injection. If such sealing should occur, the spring chamber fuel pressure in that particular nozzle will be lower than that of the other engine nozzles and the nozzle valve opening and closing pressure will accordingly be different, resulting in a non-uniform fuel delivery to the engine cylinders. By the arrangement of the present invention, the sealing of the spring chamber is no longer a potential problem and the spring chamber pressures will be predictable and uniform for each of the nozzle and holder assemblies of the engine.

DESCRIPTION OF THE PRIOR ART

The present invention is applicable to a wide variety of fuel injection nozzle and holder assemblies although its primary utilization is expected with nozzles of the type wherein the valve closing spring is located in axially spaced relation to an inwardly opening valve, being separated therefrom by a valve stop means. In such nozzles, the valve is usually biased toward a closed position by a concentric valve extension or a spindle extending through the stop means and engaging the spring guide. The present invention is primarily directed to the type of nozzle wherein the lifting of the valve is arrested by the engagement of the upper end of the valve with the stop means which might comprise the lower end of the holder or a spacer separating the nozzle and holder. In either instance, a bore in the stop means concentric with the nozzle valve bore receives the valve extension or spindle and is normally oversized to prevent engagement of the extension or spindle therewith during valve movement.

The sealing of the spring chamber, which the present invention has been developed to prevent, occurs when the upper end of the valve seating against the valve stop means forms a fluid-tight seal therewith which prevents even the high pressure fuel from passing by way of the oversized bore in the stop means into the spring chamber. This sealing effect is most apt to occur after the nozzle has been in service for some time and the repeated impacting of the valve end against the stop has resulted in a sealing fit between the two members when the valve is in the raised position.

SUMMARY OF THE INVENTION

In accordance with the present invention, the sealing of the spring chamber by the valve during the injection interval is prevented by the provision of passage means extending between the valve bore and the spring chamber, which passage means is continuously open to insure fuel leakage into the spring chamber during the injection interval, and fuel leakage back out of the spring chamber into the valve bore between injection intervals. The passage means may comprise a separate passage through the valve stop or may utilize the conventional oversize valve stop bore concentric with the valve bore in conjunction with a slot in either the upper end of the valve or in the lower surface of the valve stop.

It is accordingly a primary object of the present invention to provide, in a leakless fuel injection nozzle and holder assembly, means for insuring a predictable and uniform leakage fuel pressure in the spring chamber in each of the nozzle and holder assemblies of a multi-cylinder engine.

Another object of the invention is to provide such described means which is relatively simple and which can be effected in different forms to suit the structure of the nozzle and holder assemblies to which it is applied.

A further object of the invention is to provide such described means which is adaptable to a variety of types of conventional fuel injection nozzle and holder assemblies.

An additional object of the invention is to provide such described means which requires minimal alterations to the nozzle and holder components and which can accordingly be economically effected.

BRIEF DESCRIPTION OF THE DRAWINGS

FIG. 1 is an elevational view partly in section showing a leakless fuel injection nozzle and holder assembly in accordance with the present invention connected to the hydraulic head of a fuel injection pump of a preferred type;

FIG. 2 is an enlarged sectional elevational view of the lower end of the fuel injection nozzle and holder assembly shown in FIG. 1;

FIG. 3 is an enlarged sectional view taken along line 3—3 of FIG. 2 showing details of the nozzle spacer;

FIG. 4 is a partial sectional elevational view of a nozzle and holder assembly incorporating a modified embodiment of the invention; and FIG. 5 is a view similar to FIG. 4 showing another modified embodiment of the invention.

DESCRIPTION OF THE PREFERRED EMBODIMENT

With reference to the drawings and particularly FIG. 1 thereof, a hydraulic head 16 of a fuel injection pump 18 is shown connected by injection line 20 to a fuel injection nozzle and holder assembly 22. The pump 18 is of the single plunger multi-cylinder type and the nozzle and holder assembly 22 and its connecting injection line 20 are but one of a plurality of such assemblies required for an operative system, the number being equal to the number of engine cylinders.

The nozzle and holder assembly 22 comprises a generally cylindrical nozzle holder 24 having a threaded upper end 26 to which the injection line 20 is secured in sealing relation by means of a nut 28. The holder includes a threaded lower end 30 against which a spacer 32 and nozzle body 34 are secured in coaxially aligned relation by a cap nut 36 which engages a shoulder 38 of the nozzle body.

The nozzle body 34 includes a central bore 40 extending through the upper end thereof and which terminates at its lower end adjacent a conical valve seat 42 as shown in FIG. 2. A nozzle valve 44 is slidably disposed within the bore 40 and terminates at its lower end in a conical tip 46 adapted to cooperate with the valve seat 42. The bore 40 includes an annulus 48, and the valve 44 is reduced in diameter within and below the annulus 48 to form an annular passage 50 between the annulus 48 and the valve seat 42. The nozzle body terminates at its lower end in a nozzle tip 52 having a hollow interior chamber 54 known as a sac which communicates with the passage formed between the valve seat and the valve tip when the valve is in the raised open position illustrated. Orifices 56 in the nozzle tip 52 permit fuel under pressure to pass from the sac 54 into the combustion chamber of an engine in a predetermined spray pattern.

An extension 58 of the valve 44 extends concentrically from the upper end 60 of the valve, passing through an enlarged bore 62 in the spacer 32 into a spring chamber 63 in the holder 24. The upper end of the valve extension 58 engages a spring guide 64 on which is seated the lower end of a compression coil spring 66 disposed within the spring chamber 63 and bearing at its upper end against the end of the chamber. The spring 66 maintains a closing force on the valve 44, which force must be overcome by the injection pressure of the fuel in order to open the valve as described below.

The fuel passage of the injection line 20 communicates with a passage 68 in the nozzle holder, a passage 70 in the spacer 32, and a passage 72 in the nozzle body opening into the annulus 48. Metered quantities of fuel in the proper timed relation to the engine cycle are pumped by the pump 18 through injection line 20 and passages 68, 70 and 72 into the annulus 48 and thence the annular passage 50 whereupon the pressure acting on the area differential between the upper part of the valve 44 and the non-exposed lower area of the valve seat 42 creates an opening force sufficient to overcome the force of the spring 66 and lift the valve 44 until the upper end 60 of the valve engages the bottom of the spacer 32. The high pressure fuel enters the sac 54 and passes through the small spray orifices 56 whereupon it is atomized for burning within the engine combustion chamber.

As shown in FIGS. 2 and 3, the spacer 32 is maintained in the proper angular relationship with the holder 24 and the nozzle body 34 by dowel pins 74 in the spacer 32 which fit into aligned bores 76 and 78 respectively in the holder 24 and the nozzle body 34. In view of the possibility that the spacer may be assembled upside down, an alternative passage 70*a* is provided in the spacer which in the inverted position of the spacer will connect the passages 68 of the holder and 72 of the valve body.

The illustrated nozzle and holder assembly 22 is of the leakless type, meaning that fuel leakage around the upper end of the valve 44 which passes into the spring chamber 63 is not removed to a sump as in the conventional nozzle. Instead, this fuel is permitted to leak back along the valve during the periods between injection, and the pressure in the injection lines is reduced sufficiently between injections to prevent a pressure buildup in the spring chamber sufficient to prevent the proper opening of the valve. Since the pressure buildup in the spring chamber will effectively augment the force of the spring in closing the valve, it is important that this pressure buildup be uniform in each of the engine nozzles. Since the upper end of the valve 60 bearing against the lower surface of the spacer 32 may cause a sealing of the bore 62 during the injection interval and thus prevent a predictable buildup in the spring chamber 63, passage means are provided to insure communication between the spring chamber 63 and the upper end of the bore 40 in the event that such a sealing relationship should take place between the upper end of the valve and the lower surface of the spacer. In the preferred embodiment of FIGS. 1–3, this means comprises a counterbore 80 in the upper end of the bore 40 and a passage 82 in the spacer located radially outwardly of the valve 44 and extending between the counterbore 80 and the spring chamber 63. Should the bore 62 become sealed during the injection interval by the engagement of the valve upper end against the spacer, the leakage high pressure fuel passing between the valve 44 and bore 40 will pass by means of counterbore 80 and passage 82 into the spring chamber 63. It should be noted that the sectional views of FIGS. 1 and 2 insofar as the spacer 32 are concerned are not true sections but have been modified to show in a single sectional view the passage 70, passage 82 and one of the dowel pins 76.

The hydraulic head 16 is seen to comprise a substantially cylindrical assemblage which is disposed within a vertical bore 84 of the fuel pump housing 86. The hydraulic head 16 is sealed within the bore 84 by means of a lower flange 88 thereof seated on a seal ring 90 disposed on a shoulder of the housing 86. The hydraulic head is sealed along its upper periphery by a seal ring 94. Between the flange 88 and the seal ring 94, the hydraulic head is set back from the bore 84 to establish an annular gallery between the hydraulic head body and the casing bore. An annular portion 96 of the hydraulic head, which is known as a gallery guard, is sealed to the bore 84 by seal ring 98, and divides the gallery into a lower gallery 100 and an upper gallery 102. Fuel to be pumped is delivered under a relatively low pressure, for example 20 to 30 psi, into the upper gallery 102 through an inlet port (not shown), the upper gallery constituting a fuel supply chamber. The low pressure fuel is supplied by a gear pump (not shown) and is delivered to the fuel supply chamber after passing through several filtration stages. Although the lower gallery 100 is sealed from the upper gallery 102 by the gallery guard 96, fluid communication is provided between the lower and upper galleries by a bleed passage (not shown).

The hydraulic head 16 includes a central vertical bore 108 within which a pumping and distributing plunger 110 is slidably and rotatably disposed. The bore 108, which passes completely through the hydraulic head 16, is closed at its upper end by a plug 112 sealed therein by seal ring 114 and secured by the screw 116. A fuel pumping chamber 118 is formed within the bore 108 between the top of the plunger 110 and the plug 112.

The plunger 110 is driven in rotation and reciprocation by an engine-driven camshaft in a conventional manner. Since the illustrated pump is designed to supply fuel to a six cylinder engine, there are six axial pumping strokes of the plunger 110 for each plunger revolution. The plunger will accordingly rotate 60° during each pumping cycle.

The low pressure fuel passes from the upper gallery 102 (fuel supply chamber) into a pumping chamber 118 during the suction stroke of the plunger through radial fuel passages 148 and upper fuel ports 150 extending between the fuel passages 148 and the bore 108. In order to permit entry of fuel from the ports 150 into the pumping chamber 118 before the upper end 154 of the plunger has cleared the upper ports 150 on the downstroke of the plunger, notches 156 are provided in the edge of the plunger at 60° intervals. The notches are located so as to open the pumping chamber to the upper ports 150 during the downstroke of the plunger but to rotate out-of-phase with the ports 150 during the upstroke of the plunger. Although only a single fuel passage 148 and upper fuel port 150 shows in the view of FIG. 1, there are six fuel passages 148 and six fuel ports 150 which are spaced at 60° intervals.

The plunger 110 includes a coaxial bore 158 opening into the pumping chamber 118 at its upper end. A delivery port 160 communicating with the bore 158 opens into a distributor slot 162 which sequentially communicates with fuel outlet passages 164 during the upstroke (pumping stroke) of the plunger. There are six outlet passages 164 spaced at 60° intervals and as shown in FIG. 1, each of the outlet passages 164 communicates with a central passage 166 of a threaded connector 168 threadedly attached to the hydraulic head. The injection line 20 is attached to the connector 168 by means of a nut 170.

Although not shown in the drawings, the plunger bore 158 continues downwardly within the plunger and communicates with an intersecting spill port which opens into a spill sump 178 to terminate injection, the timing of the injection termination and hence the quality of fuel injected depending on the position of a control sleeve 182 slidably disposed on the plunger and axially positioned with respect to the plunger by means of a linkage from the pump governor. The spill pump 178 communicates with the lower gallery 100 which as indicated above in turn communicates with the fuel supply chamber 102 by means of a bleed passage. The structure and operation of the control sleeve 182 are well known in the injection pump art as shown for example in U.S. Pat. No. 3,371,610, issued Mar. 5, 1968.

Since the fuel pump disclosed does not utilize a delivery valve, means are provided to maintain a uniform residual pressure in each fuel outlet passage 164 and injection line 20 as well as the fuel passages connected therewith within the nozzle holder and nozzle, which line and passages collectively are referred to as a fuel distribution passage. This means comprises means for placing the fuel distribution passages in communication with the low pressure fuel in the upper gallery between injection intervals. A pair of flats 186 on the plunger (only one of which is visible in FIG. 1) are disposed on the opposite side thereof from the distributor slot 162 and axially extend so as to place the lower fuel inlet ports 152 in communication with certain of the idle fuel outlet passages 164. This arrangement insures a predetermined pressure in the fuel distribution passages so that the fuel delivery through the passages to each nozzle will be both uniform and predictable.

In the operation of the pump and nozzle and holder assembly, during the pumping stroke of the plunger the plunger is rotationally disposed so that the plunger notches 156 lie between the fuel inlet ports 150 while the distributor slot 162 communicates with one of the outlet passages 164 to direct high pressure fuel thereinto as shown in FIG. 1. At the same time, the flats 186 of the plunger connect certain of the lower fuel ports 152 with idle outlet passages 164 to produce a uniform fuel pressure in those passages. The high pressure fuel from the pumping chamber passes through passages 164 and 166 into the injection line 20 and thence through nozzle holder passage 68, spacer passage 70 and nozzle passage 72 into annulus 48 and annular passage 50. As indicated above, the pressure acting on the area differential between the upper part of the valve 44 and the non-exposed lower area of the valve seat 42 creates an opening force sufficient to overcome the force of the spring 66 and residual pressurized fuel in the spring chamber and lifts the valve 44 until the upper end 60 of the valve engages the bottom of the spacer 32 as shown in FIGS. 1 and 2. The lifting of the valve 44 permits the flow of high pressure fuel into the sac 54 and out through the spray orifices 56 into the engine combustion chamber.

The high pressure fuel, which typically is in excess of 10,000 psi, will also pass along the upper part of the bore 40 around the valve and will normally penetrate into and pressurize the spring chamber. As long as the average fuel pressure level in the spring chamber can be predicted for a given load and speed condition of the engine, the pressurized fuel in the spring chamber is useful in augmenting the spring force in applying a closing pressure on the upper end of the valve. This spring-augmenting pressure of the fuel in the spring chamber is particularly advantageous since the spring chamber fuel pressure will drop under low speed and part load conditions when a lesser nozzle opening pressure is desired.

To insure that the pressure level of the fuel leaking into the spring chamber is predictable, it is necessary that there by fluid communication between the valve bore 40 and the spring chamber at all times. Since the engagement of the upper end of the valve 44 can under some circumstances develop a sealing engagement with the lower surface of the spacer thereby blocking leaking flow from bore 40 to spacer bore 62, it is necessary that alternate passage means be provided linking the bore 40 with the spring chamber 63. In the preferred embodiment of the invention, the passage means comprises the above-described counterbore 80 in the nozzle body 34 and the passage 82 in the spacer which extends between the spring chamber and the counterbore 80.

Upon termination of injection, the fuel pressure in the fuel distribution passages drops to a level of several hundred pounds per square inch since there is no delivery valve and each fuel distribution passage is initially connected directly with the spill sump. The valve 44 will close immediately upon the drop in pressure of the annulus 48 and annular passage 50 thereby cutting off flow to the spray orifices. The reduction in fuel pressure in the annulus 48 permits a reverse leakage of fuel from the spring chamber 63 and the fuel amount leaking into the spring chamber during the injection interval will equal the fuel leakage out of the chamber between injection. The spring chamber pressure accordingly becomes stabilized and is approximately equal to the average pressure in the injection line. The predictability of the fuel pressure in the spring chamber provided by the constantly available passage between the spring chamber and the upper end of the valve bore insures a predictable opening and closing pressure of the valve which is important in a multi-cylinder engine to insure a uniform fuel delivery to and work output from each engine cylinder.

A modified form of the invention is shown in FIG. 4 wherein the spacer 32' and the nozzle body 34' have been modified to provide a different form of passage means connecting the spring chamber with the valve bore. This passage means in the FIG. 4 embodiment comprises a radial slot 200 in the lower face of the spacer extending from the central spacer bore 62' radially outwardly to communicate with the valve bore 40'. The leakage fuel will accordingly travel from the bore 40' through the slot 200 and bore 62' into the spring chamber. A second slot 202 is provided on the upper face of the spacer 32' to serve the function of the slot 200 in the event the spacer should be assembled in an inverted position.

A further modified form of the invention is shown in FIG. 5 wherein the spacer 32'' has neither holes nor slots, but the passage means for the leakage fuel from the valve bore to the spring chamber is provided by a slot 204 in the upper end of the valve 44'', which slot extends from the wall of the bore 40'' radially inwardly to communicate with the bore 62'' of the spacer. The effect in each of the embodiments disclosed is of course the same, namely, to permit a flow of leakage fuel to and from the spring chamber so that the spring chamber pressure is predictable and uniform for each of the nozzles of the engine.

Although the embodiments described above each include a spacer between the nozzle and holder serving as the stop means for the nozzle valve, it will be apparent that the invention could be carried out with other forms of nozzle and holder assemblies wherein the valve stop means comprises a portion of the holder, the spring in such embodiments being inserted into the spring chamber from the upper end of the holder. In such alternate embodiments, the passage means connecting the valve bore with the spring chamber could comprise either a hole in the holder communicating with a counterbore in the valve bore, a slot in the top of the valve, or a slot in the bottom of the holder, each said slots joining said valve bore with an enlarged central bore in said stop means.

Manifestly, changes in details of construction can be effected by those skilled in the art without departing from the spirit and scope of the present invention.

We claim:

1. In a leakless fuel injection nozzle and holder assembly comprising a nozzle having a bore therein, a valve slidably disposed within said nozzle bore and actuatable by high pressure fuel introduced into a chamber defined by said bore and said valve for movement of said valve from a closed to an open position, a fixed volume spring chamber without leak-off ports in said holder, valve stop means between said nozzle bore and said spring chamber for limiting the opening movement of said valve, a compression spring in said spring chamber, and means extending through said stop means connecting said spring with said valve to bias said valve toward a closed position, said spring chamber being closed to fluid entry except for leakage fuel passing thereinto from between said valve and nozzle bore, said spring chamber being subject to a sealing closure preventing entry of leakage fuel thereinto when said valve is in the open position by engagement of said valve with said valve stop means, the improvement comprising means for preventing the sealing closure of said spring chamber when said valve is in the open position, said means comprising passage means continuously connecting the end of said nozzle bore adjacent said stop means with said spring chamber whereby leakage fuel may pass through said passage means into said spring chamber from said nozzle bore when said valve is in the open position against said stop means.

2. The invention as claimed in claim 1 wherein said passage means comprises a counterbore in said end of said nozzle bore, and a passage in said stop means extending through said stop means and communicating with said counterbore and said spring chamber.

3. The invention as claimed in claim 1 including a bore in said stop means for passage of said means connecting said spring and valve, and wherein said passage means comprises a slot in said valve communicating with said nozzle bore and said bore in said stop means.

4. The invention as claimed in claim 1 including a bore in said stop means for passage of said means connecting said spring and valve, and wherein said passage means comprises a slot in said stop means communicating with said nozzle bore and with said bore in said stop means.

5. In a leakless fuel injection nozzle and holder assembly comprising a nozzle having a bore therein, a valve slidably disposed within said nozzle bore and actuatable by high pressure fuel introduced into a chamber defined by said bore and said valve for movement of said valve from a closed to an open position, a fixed volume spring chamber without leak-off ports in said holder, a spacer between said nozzle and said holder serving as a stop means for limiting the opening movement of said valve, a compression spring in said spring chamber, a bore extending through said spacer concentric with said nozzle bore, and means extending through said spacer bore connecting said spring with said valve to bias said valve toward a closed position, said spring chamber being closed to fluid entry except for leakage fuel passing thereinto from between said valve and nozzle bore, said spring chamber being subject to a sealing closure preventing entry of leakage fuel thereinto when said valve is in the open position by engagement of said valve with said spacer, the improvement comprising means for preventing the sealing closure of said spring chamber when said valve is in the open position, said means comprising passage means continuously connecting the end of said nozzle bore adjacent said spacer with said spring chamber whereby leakage fuel may pass through said passage means into said spring chamber from said nozzle bore when said valve is in the open position against said spacer.

6. The invention as claimed in claim 5 wherein said passage means comprises a counterbore in said end of said nozzle bore, and a passage extending through said spacer and communicating with said counterbore and said spring chamber.

7. The invention as claimed in claim 5 wherein said passage means comprises a slot in said valve communicating with said nozzle bore and said spacer bore.

8. The invention as claimed in claim 5 wherein said passage means comprises a slot in said spacer communicating with said nozzle bore and with said spacer bore.

9. In a leakless fuel injection nozzle and holder assembly comprising a nozzle having a bore therein, a valve slidably disposed within said nozzle bore and actuatable by high pressure fuel introduced into a chamber defined by said bore and said valve for movement of said valve from a closed to an open position, a fixed volume spring chamber without leak-off ports in said holder, valve stop means between said nozzle bore and said spring chamber, a shoulder on said valve engageable with said valve stop means for limiting the opening movement of said valve, a compression spring in said spring chamber, a bore in said valve stop means, and means extending through said stop means bore connecting said spring with said valve to bias said valve toward a closed position, said stop means bore being larger than said extending means to permit leakage fuel flow therethrough, said spring chamber being closed to fluid entry except for leakage fuel passing thereinto from between said valve and nozzle bore, said spring chamber being subject to a sealing closure preventing entry of leakage fuel thereinto when said valve is in the open position by engagement of said valve shoulder with said valve stop means, the improvement comprising means for preventing the sealing closure of said spring chamber when the valve is in the open position, said means comprising passage means connecting the end of said nozzle bore adjacent said stop means with said spring chamber when said valve is in the open position with the shoulder thereof against said stop means and covering said stop means bore, said passage means preventing the sealing of the spring chamber by the valve during the injection interval.

* * * * *

UNITED STATES PATENT AND TRADEMARK OFFICE

CERTIFICATE OF CORRECTION

PATENT NO. : 4,266,728

DATED : May 12, 1981

INVENTOR(S) : James R. Voss and Richard E. Vanderpoel

It is certified that error appears in the above—identified patent and that said Letters Patent is hereby corrected as shown below:

Column 4, line 29 after "predictable" insert --pressure--

Signed and Sealed this

*Twenty-eighth* Day of *July 1981*

[SEAL]

*Attest:*

GERALD J. MOSSINGHOFF

*Attesting Officer*

*Commissioner of Patents and Trademarks*